US005957537A

United States Patent [19]

Hoolahan

[11] Patent Number: 5,957,537

[45] Date of Patent: Sep. 28, 1999

[54] RESTRAINING DEVICE FOR CHILDREN

[76] Inventor: Patricia K. Hoolahan, 5040 Cramlington Ct., Gibsonia, Pa. 15044

[21] Appl. No.: 09/009,146

[22] Filed: Jan. 20, 1998

[51] Int. Cl.[6] ..... A47C 31/00

[52] U.S. Cl. ..... 297/464; 297/250.1

[58] Field of Search ..... 297/464, 465, 297/466, 467, DIG. 6, 250.1, 483, 485

[56] References Cited

U.S. PATENT DOCUMENTS

| | | | |
|---|---|---|---|
| 2,495,482 | 1/1950 | Rogatz | 155/45 |
| 3,093,407 | 6/1963 | Wilson | 297/4 |
| 4,188,065 | 2/1980 | Meeker | 297/485 |
| 4,330,152 | 5/1982 | Legan et al. | 297/465 |
| 4,383,713 | 5/1983 | Roston | 297/219 |
| 4,571,000 | 2/1986 | Holder | 297/465 X |
| 4,674,800 | 6/1987 | Ensign | 297/465 |
| 4,759,588 | 7/1988 | Husnik | 297/250.1 X |
| 4,795,216 | 1/1989 | Culver et al. | 297/465 X |
| 4,921,273 | 5/1990 | Weightman et al. | 297/482 X |
| 4,981,307 | 1/1991 | Walsh | 297/465 X |
| 5,161,258 | 11/1992 | Coltrain | 297/465 X |
| 5,310,245 | 5/1994 | Lyszczasz | 297/219.12 |
| 5,426,801 | 6/1995 | Klearman et al. | 297/465 X |
| 5,429,418 | 7/1995 | Lipper et al. | 297/465 |
| 5,575,044 | 11/1996 | Zornes | 24/168 |

FOREIGN PATENT DOCUMENTS

| | | | |
|---|---|---|---|
| 0302607 | 2/1989 | European Pat. Off. . | |
| 0347505 | 12/1989 | European Pat. Off. . | |
| 4236055 | 4/1994 | Germany | 297/465 |

*Primary Examiner*—Milton Nelson, Jr.
*Attorney, Agent, or Firm*—Webb Ziesenheim Logsdon Orkin & Hanson, P.C.

[57] ABSTRACT

A restraining device for children and primarily infants for use in cooperation with a child seat device having a restraining belt. The restraining device has a pliable body capable of receiving a child therein. A restraining belt receiving member is secured to the pliable body and defines a restraining belt passageway. The restraining belt receiving member is adapted to receive the restraining belt from the child seat device through the restraining belt passageway. An attachment belt is secured to the pliable body for attaching the restraining device to the child seat device. The restraining belt receiving member receiving the restraining belt from the child seat device acts in cooperation with the attachment belt secured to the child seat device to limit the movement of the pliable body and any child received therein.

17 Claims, 4 Drawing Sheets

RESTRAINING DEVICE FOR CHILDREN

BACKGROUND OF THE INVENTION

1. Field of the Invention

This invention relates generally to a restraining device for children and primarily infants for use in cooperation with child car seats, infant carriers, baby seats, high chairs, strollers, and the like having a restraining belt.

2. Description of Prior Art

Small children and infants are not adequately restrained by current child-related seating devices such as child car seats, infant carriers, baby seats, high chairs, strollers, and the like (hereinafter collectively referred to as "child seat devices"). The problem manifests itself when a child is placed in a child seat device. Children, from birth to one or two years old, often cannot adequately support themselves in a seated position. As a result, a child seated in the child seat device has a propensity to slide downward within the child seat device. This is disadvantageous because the child may slip through a restraining belt typically provided with the child seat device and fall out of the child seat device, potentially causing injury to the child. This concern is especially great with child car seats, where an improperly restrained child could sustain greater injuries in the event of an automobile accident.

The prior art devices attempting to deal with this problem have typically used cushion supports with tying restraints to maintain the proper positioning of the child within the child seat device. For example, U.S. Pat. No. 5,310,245 to Lyszczasz teaches a cushion support apparatus for infants having a T-shaped cushion member that is adapted to conform to an internal profile of a child car seat or an infant carrier. Rolled lateral cushion supports are provided adjacent to the head and body of the child to maintain the proper positioning of the child's head and body while seated in the child car seat or infant carrier.

In operation, the child is placed on the T-shaped cushion member and the child's head and body are secured between the rolled lateral cushion supports by a plurality of tying restraints. The child thereby secured to the cushion member is then placed in the child car seat or infant carrier.

The disadvantages of prior art devices that use cushion supports are that these devices are bulky and uncomfortable for the child secured therein. Further, it is difficult to secure the child's head and body between the cushion supports. Additionally, the cushion support apparatus is not typically designed to easily cooperate with child seat devices. Also, a plurality of fastening straps is generally required to maintain the child within the cushion supports. Finally, the child must be placed in the cushion support apparatus before being placed in the child seat device.

It is therefore an object of the present invention to overcome the above-discussed disadvantages by providing a lightweight restraining device capable of receiving a child's body therein and which easily cooperates with a child seat device.

SUMMARY OF THE INVENTION

The foregoing objective is accomplished with a restraining device and method of restraining a child disclosed hereinafter. Particularly, the invention is a restraining device for children and primarily infants for use in cooperation with a child seat device having a restraining belt. The restraining device has a pliable body with a child receiving pocket defined therein and leg openings defined at the bottom of the child receiving pocket. A restraining belt receiving member is secured to the pliable body and defines a restraining belt passageway, through which passes the restraining belt of the child seat device. An attachment belt is attached to an outer surface of the pliable body and used to attach the restraining device to the child seat device.

Further details and advantages of the invention will become apparent from the following detailed description, in conjunction with the drawings.

DETAILED DESCRIPTION OF THE PREFERRED EMBODIMENTS

Figure 1:
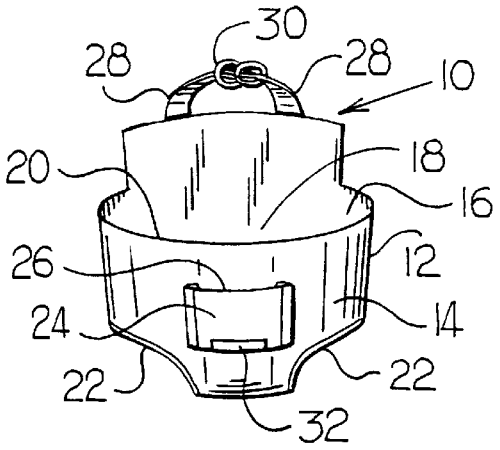
FIG. 1 is a front elevational view of a first embodiment of a restraining device for children made in accordance with the present invention.
Figure 2:
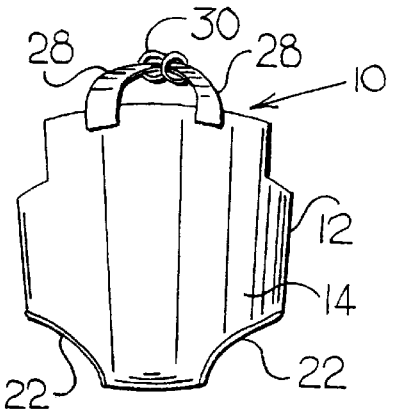
FIG. 2 is a rear elevational view of the restraining device shown in FIG. 1.

FIGS. 1 and 2 show a restraining device 10 made in accordance with the present invention that includes a pliable body 12. The pliable body 12 is made of a flame retardant fabric. The pliable body 12 has an outer surface 14 and an inner surface 16. The inner surface 16 defines a child receiving pocket 18 for receiving a child's body. The inner surface 16 additionally defines a mouth opening 20 and leg openings 22.

A restraining belt receiving member 24 is secured to the outer surface 14 of the pliable body 12. The restraining belt receiving member 24 defines a restraining belt passageway 26. Attachment belts 28 are connected to the pliable body 12 on the outer surface 14 thereof. The attachment belts 28 are detachably connected together by a connecting adjustable buckle 30. The restraining device 10 further includes light-reflective strips 32 attached to the restraining belt receiving member 24 for safety purposes.

Figure 3:
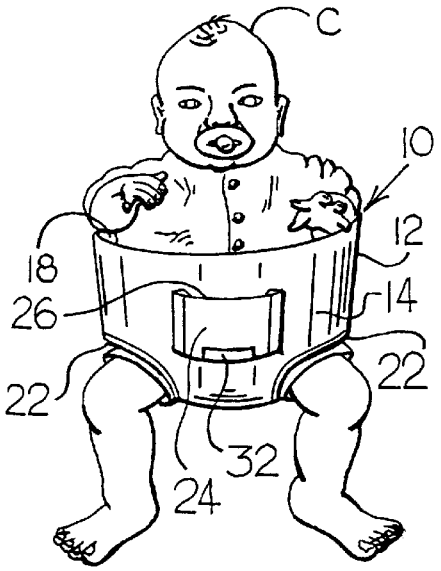
FIG. 3 is a front elevational view of a child received within the restraining device shown in FIG. 1.
Figure 4:
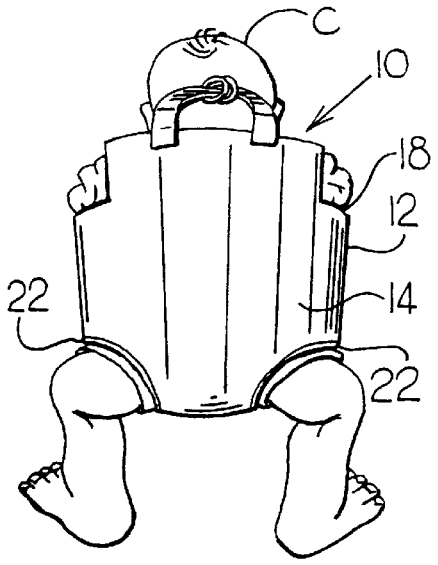
FIG. 4 is a rear elevational view of a child received within the restraining device shown in FIG. 2.

FIGS. 3 and 4 show a child C received by the restraining device 10. The child receiving pocket 18 is adapted to receive the body of the child C by having its body pass through the mouth opening 20 and legs pass through the leg openings 22.

Figure 5:
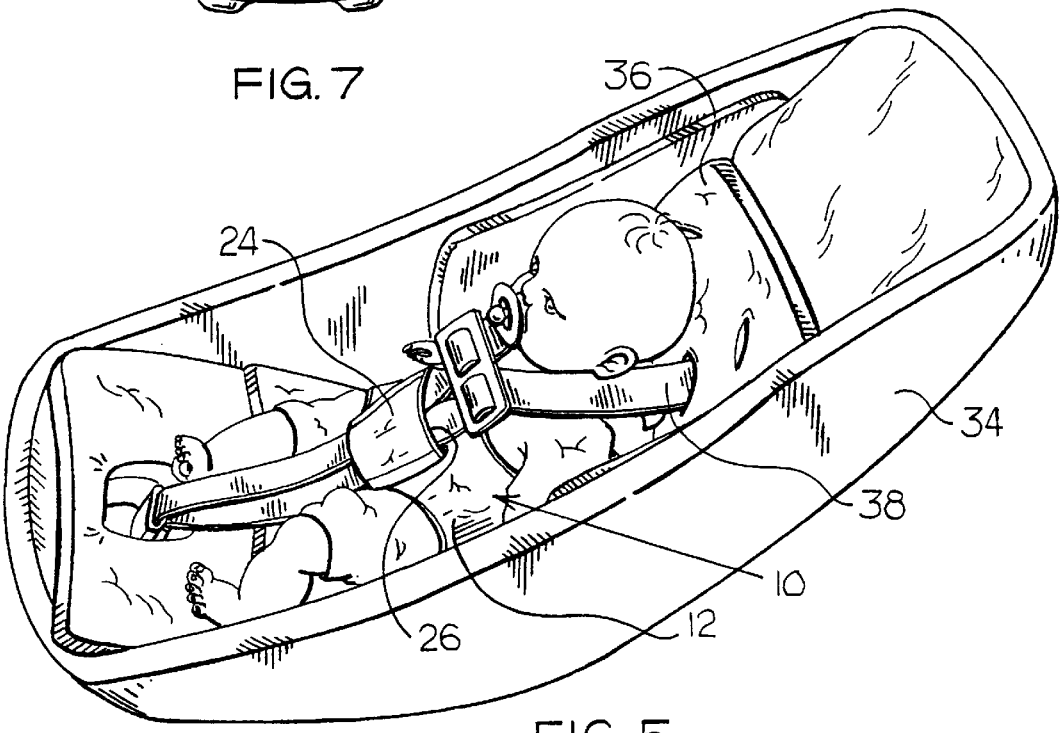
FIG. 5 is a top perspective view showing a child received within the restraining device shown in FIG. 1 and the restraining device cooperating with a child seat device.

FIG. 5 shows a child seat device 34 with the child C seated therein. The child seat device 34 has an internal surface 36. The child seat device 34 is provided with a restraining belt 38 for restraining the movement of the child C.

Figure 6:
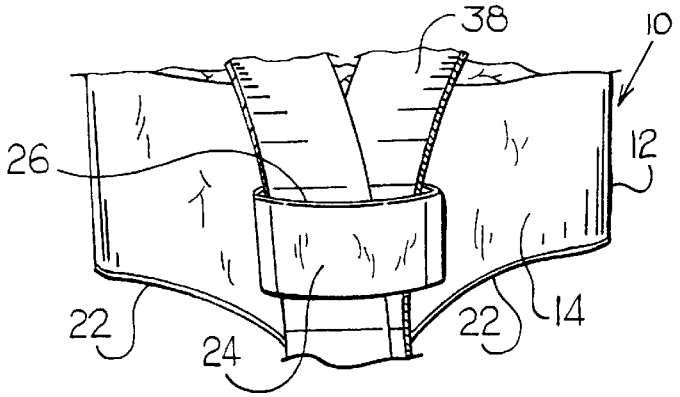
FIG. 6 is a partial front elevational view of the restraining device shown in FIG. 1 showing the restraining device cooperating with a restraining belt from a child seat device.

FIGS. 5 and 6 show the restraining device 10 cooperating with the restraining belt 38 of the child seat device 34. The restraining device 10 has the restraining belt receiving member 24 attached to the outer surface 14 of the pliable body 12 so that the movement of the pliable body 12 and the child C received therein is limited when the restraining belt 38 of the child seat device 34 passes through the restraining belt receiving member 24.

Referring again to FIGS. 1 and 2, the attachment belts 28 are secured to the pliable body 12 and positioned on the pliable body 12 for easy attachment to the child seat device 34. The attachment belts 28 are joined together by the connecting adjustable buckle 30 to attach the restraining device 10 to the child seat device 34. The attachment belts 28 attached to the child seat device 34, in combination with the restraining belt 38 from the child seat device 34 passing through the restraining belt receiving member 24, further limit the movement of the pliable body 12 and the child C received therein.

Figure 7:
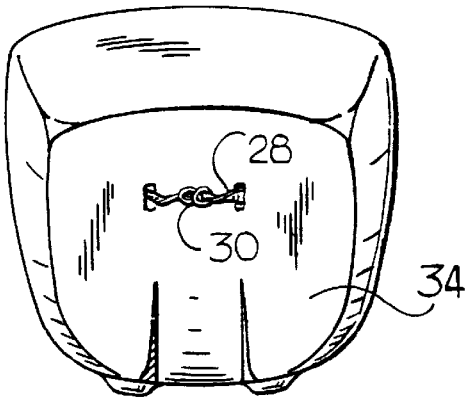
FIG. 7 is a rear elevational view of the child seat device shown in FIG. 5.

Referring to FIG. 7, the attachment belts 28 are shown attached to the child seat device 34 and connected together by the connecting adjustable buckle 30. Alternatively, the attachment belts 28 and connecting adjustable buckle 30 can be replaced by a hook and loop fastener, such as VELCRO® or other similar fastening device.

In operation, the first embodiment of the restraining device 10 co-acts with the restraining belt 38 to restrain the child C when positioned within the child seat device 34. The child C is placed in the restraining device 10 by passing the body of the child C through the mouth opening 20, with the child's legs passing through the leg openings 22. The child C received within the child receiving pocket 18 is placed in the child seat device 34 so that the outer surface 14 of the pliable body 12 rests on the internal surface 36 of the child seat device 34. The attachment belts 28 are attached to the child seat device 34. The restraining belt 38 from the child seat device 34 is passed through the restraining belt passageway 26 defined by the restraining belt receiving member 24 and connected to the child seat device 34.

Alternatively, the first embodiment of the child restraining device 10 is practiced by placing the restraining device 10 within the child seat device 34 so that the outer surface 14 of the pliable body 12 rests on the internal surface 36 of the child seat device 34. The attachment belts 28 are attached to the child seat device 34. The child C is placed in the restraining device 10 by passing the body of the child through the mouth opening 20, with the child's legs passing through the leg openings 22. The restraining belt 38 from the child seat device 34 is passed through the restraining belt passageway 26 defined by the restraining belt receiving member 24 and connected to the child seat device 34.

Figure 8:
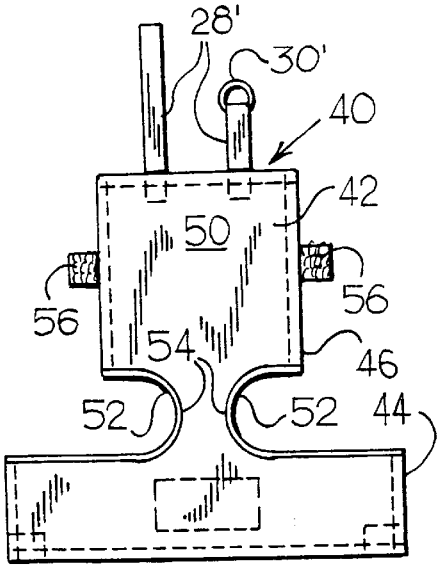
FIG. 8 is a top plan view of a forming member for forming a second embodiment of a restraining device for children made in accordance with the present invention.
Figure 9:
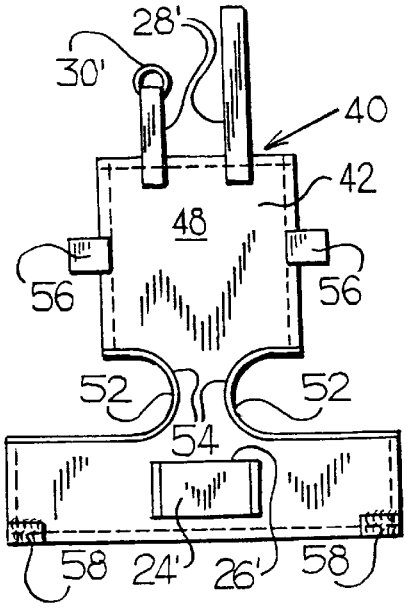
FIG. 9 is a bottom plan view of the forming member shown in FIG. 8.

FIGS. 8 and 9 show a forming member 40 for forming a second embodiment of a restraining device 10' made in accordance with the present invention. Restraining device 10' is similar to restraining device 10 wherein like reference numerals are designated by primed reference numbers to designate like parts. The forming member 40 includes a planar and symmetrically shaped pliable body member 42. The pliable body member 42 includes a crossmember 44 with an elongated member 46 depending therefrom. The pliable body member 42 has a front surface 48 and a rear surface 50. A pair of concave profiles 52 is defined at a peripheral outer edge 54 of the elongated member 46 and positioned adjacent to the cross-member 44.

Detachable members 56 are secured on the front surface 48 of the pliable body member 42 and positioned on the elongated member 46. Connecting members 58 are secured on the front surface 48 of the pliable body member 42 and positioned on the cross-member 44. The detachable members 56 removably connect to the connecting members 58. The detachable members 56 and the connecting members 58 are hook and loop fasteners, such as VELCRO® or other similar fastening devices.

A restraining belt receiving member 24' is secured to the front surface 48 of the pliable body member 42. The restraining belt receiving member 24' defines a restraining belt passageway 26'. Attachment belts 28' are connected to the pliable body member 42 on the front surface 48 thereof. The attachment belts 28' are detachably connected together by a connecting adjustable buckle 30'. The restraining device 10' further includes light-reflective strips 32' attached to the restraining belt receiving member 24', for safety purposes.

Figure 10:
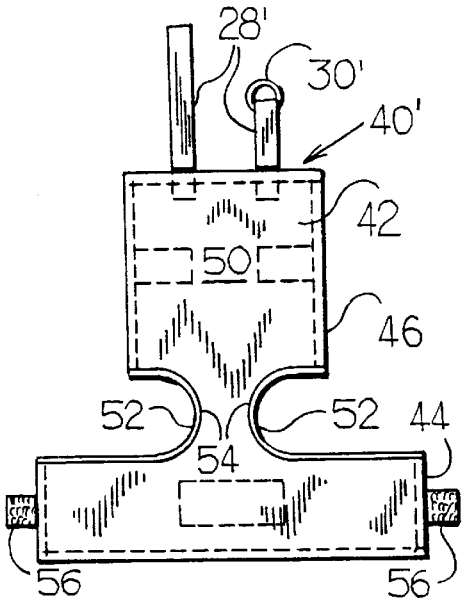
FIG. 10 is a top plan view of a forming member for forming a third embodiment of a restraining device for children made in accordance with the present invention.
Figure 11:
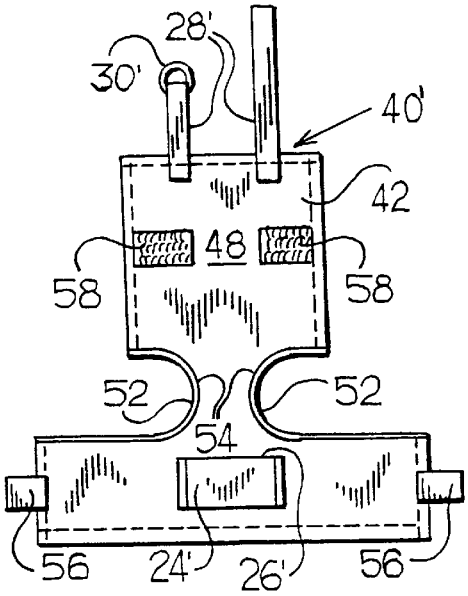
FIG. 11 is a bottom plan view of the forming member shown in FIG. 10.

FIGS. 10 and 11 show another embodiment of a forming member 40', similar to the forming member 40, wherein like reference numbers designate like parts. The only difference between the forming member 40 and the forming member 40' is that forming member 40' has the detachable members 56 positioned on the cross-member 44 and the connecting members 58 positioned on the elongated member 46.

Figure 12:
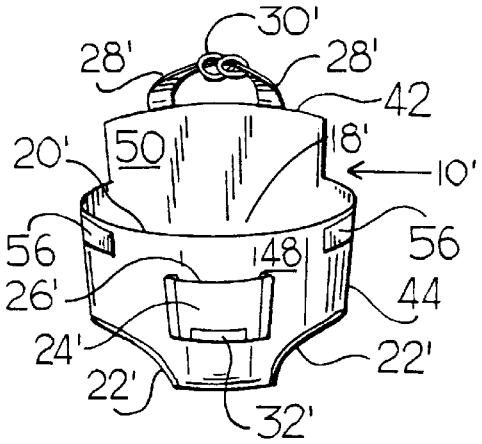
FIG. 12 is a front elevational view of a formed second embodiment of a restraining device for children made in accordance with the present invention.
Figure 13:
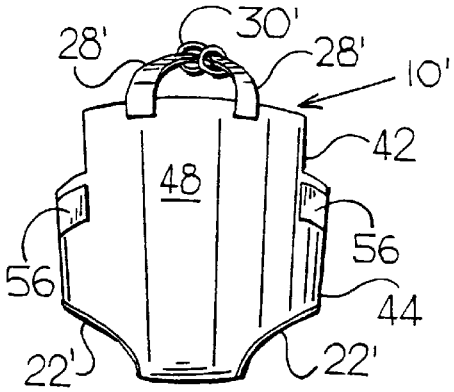
FIG. 13 is a rear elevational view of the restraining device shown in FIG. 12.

FIGS. 12 and 13 show the restraining device 10' formed by the forming member 40. The forming member 40 forms the restraining device 10' by connecting the detachable members 56 to the connecting members 58. In particular, the detachable members 56 and the connecting members 58 are each positioned on the pliable body member 42 such that with the detachable members 56 connected to the connecting members 58, the rear surface 50 of the cross-member 44 faces the rear surface 50 of the elongated member 46 and forms a child receiving pocket 18' between the rear surface 50 of the cross-member 44 and rear surface 50 of the elongated member 46. The child receiving pocket 18' thereby formed has a mouth opening 20' and leg openings 22'.

Figure 14:
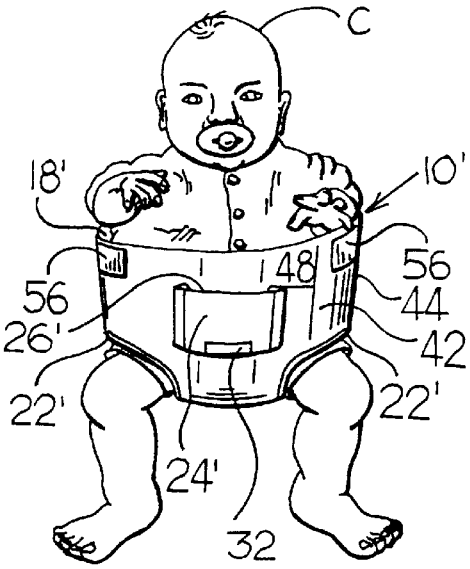
FIG. 14 is a front elevational view of a child received within the restraining device shown in FIG. 12.
Figure 15:
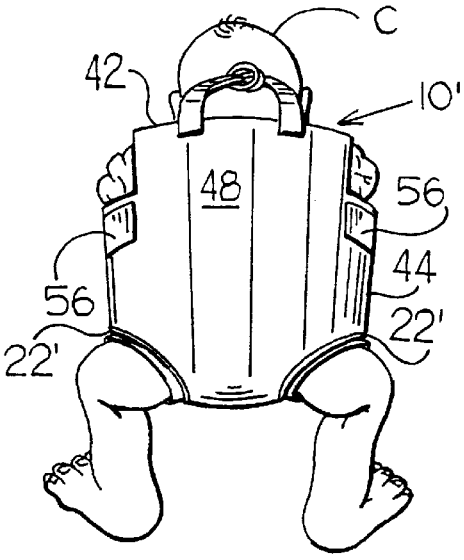
FIG. 15 is a rear elevational view of a child received within the restraining device shown in FIG. 13.

FIGS. 14 and 15 show a child C received by the formed restraining device 10'. The child receiving pocket 18' is adapted to receive the body of the child C by having its body pass through the mouth opening 20' and legs pass through the leg openings 22'.

The formed restraining device 10' co-acts with the child seat device 34 and restraining belt 38 in a similar manner as the restraining device 10 shown in FIGS. 1–4. Specifically, the child C is placed on the rear surface 50 of the pliable body member 42 such that the child's legs substantially conform with the concave profiles 52 and the child's body substantially covers the rear surface 50 of the elongated member 46. The rear surface 50 of the cross-member 44 is folded over the front of the child C and between the child's legs whereby the child C is sandwiched between the rear surface 50 of the cross-member 44 and the rear surface 50 of the elongated member 46. The detachable members 56 are connected to the connecting members 58, securing the child C within the child receiving pocket 18' defined between the rear surface 50 of the cross-member 44 and the rear surface 50 of the elongated member 46.

The child C secured within the child receiving pocket 18' is placed within the child seat device 34 such that the pliable body member 42 rests on the internal surface 36 of the child seat device 34. The attachment belts 28' are attached to the child seat device 34. The restraining belt 38 of the child seat device 34 is passed through the restraining belt passageway 26' defined by the restraining belt receiving member 24' and connected to the child seat device 34.

Alternatively, the forming member 40 can be placed within the child seat device 34 with the pliable body member 42 resting on the internal surface 36. The attachment belts 28' are attached to the child seat device 34. The child C is placed on the rear surface 50 of the pliable body member 42 such that the child's legs substantially conform with the concave profiles 52 and the child's body substantially covers the rear surface 50 of the elongated member 46. The rear surface 50 of the crossmember 44 is folded over the front of the child C and between the child's legs whereby the child is sandwiched between the rear surface 50 of the cross-member 44 and the rear surface 50 of the elongated member 46. The detachable members 56 are connected to the connecting member 58, securing the child C within the child receiving pocket 18' defined between the rear surface 50 of the cross-member 44 and the rear surface 50 of the elongated member 46. The restraining belt 38 of the child seat device 34 is passed through the restraining belt passageway 26' defined by the restraining belt receiving member 24' and is connected to the child seat device 34.

While the preferred embodiment and presently best known mode of the invention have been described above, various modifications and variations of the invention may be made without departing from the spirit and scope of the invention.

What is claimed is:

1. A restraining device comprising:

a) a pliable body having an outer surface and an inner surface, said inner surface defining a child receiving pocket having a mouth opening and leg openings, said child receiving pocket adapted to receive a body of a child having its body pass through said mouth opening and legs pass through said leg openings;

b) a restraining belt receiving member secured to said outer surface of said pliable body and defining a restraining belt passageway configured to receive a restraining belt from a supplemental child seat device, wherein when the restraining belt passes through said restraining belt passageway defined in said restraining belt receiving member, movement of said pliable body and the child received therein is limited; and c) an attachment belt configured to attach to the child seat device, said attachment belt including two elongated flexible members secured to said pliable body and means for connecting said members to attach said attachment belt to the child seat device, wherein when said attachment belt is attached to the child seat device in combination with the restraining belt from the child seat device passing through said restraining belt receiving member, movement of said pliable body and the child received therein is further limited.

2. The restraining device of claim 1 further comprising light-reflective strips secured to said pliable body.

3. The restraining device of claim 1 wherein said means for connecting said members includes an adjustable buckle.

4. The restraining device of claim 1 wherein said means for connecting said members includes a hook and loop fastener.

5. An apparatus for restraining a child comprising:

a) a supplemental child seat device configured to co-act with a primary seat and having a restraining belt;

b) a restraining device co-acting with said child seat device, said restraining device having a pliable body with an outer surface and an inner surface, said inner surface defining a child receiving pocket having a mouth opening and leg openings, said child receiving pocket adapted to receive a body of a child having its body pass through said mouth opening and legs pass through said leg openings;

c) a restraining belt receiving member secured to said outer surface of said pliable body and defining a restraining belt passageway configured to receive a restraining belt from said child seat device, wherein the restraining belt passing through said restraining belt passageway defined in said restraining belt receiving member limits movement of said pliable body and the child received therein; and d) an attachment belt configured to attach to said child seat device, said attachment belt including two elongated flexible members secured to said pliable body and means for connecting said members to attach said attachment belt to said child seat device, wherein said attachment belt being attached to said child seat device in combination with the restraining belt from said child seat device passing through said restraining belt receiving member further limits movement of said pliable body and the child received therein.

6. The apparatus for restraining a child as claimed in claim 5 wherein said means for connecting said members includes a hook and loop fastener.

7. The apparatus for restraining a child as claimed in claim 5 further comprising light-reflective strips secured to said pliable body.

8. The apparatus for restraining a child as claimed in claim 5 wherein said means for connecting said members includes an adjustable buckle.

9. A forming member for forming a restraining device comprising:

a) a substantially planar and symmetrically shaped pliable body member defined by a cross-member with an elongated member depending therefrom, said pliable body member having a front surface and a rear surface, said elongated member having a pair of concave profiles defined at a peripheral outer edge of said elongated member adjacent to said cross-member;

b) detachable members attached to said pliable body member for connecting to connecting members attached to said pliable body member, said detachable members and said connecting members each positioned on said pliable body member whereby when said detachable members are connected to said connecting members said rear surface of said cross-member faces said rear surface of said elongated member forming a child receiving pocket between said rear surface of said cross-member and said rear surface of said elongated member, said child receiving pocket having a mouth opening and leg openings, said child receiving pocket adapted to receive a body of a child having its body pass through said mouth opening and legs pass through said leg openings; and c) a restraining belt receiving member secured to said front surface of said pliable body member and defining a restraining belt passageway whereby a restraining belt from a child seat device passing through said restraining belt passageway defined in said restraining belt receiving member limits movement of said child receiving pocket and the child received therein.

10. The forming member for forming the restraining device of claim 9 wherein said detachable members and said connecting members include hook and loop fasteners.

11. The forming member for forming the restraining device of claim 9 further comprising light-reflective strips secured to said pliable body member.

12. The forming member for forming the restraining device of claim 9 further comprising an attachment belt secured to said pliable body member whereby said attachment belt attached to the child seat device in combination with the restraining belt from the child seat device passing through said restraining belt receiving member further limits movement of said child receiving pocket and the child received therein.

13. The forming member for forming the restraining device of claim 12 wherein said attachment belt is a belt with an adjustable buckle.

14. The forming member for forming the restraining device of claim 12 wherein said attachment belt includes a hook and loop fastener.

15. A method of restraining a child comprising the steps of:

a) providing a forming member for forming a restraining device, said forming member having a substantially planar and symmetrically shaped pliable body member defined by a cross-member with an elongated member depending therefrom, said pliable body member having a front surface and a rear surface, said elongated member having a pair of concave profiles defined at a peripheral outer edge of said elongated member adjacent to said crossmember, said pliable body member having a restraining belt receiving member secured to said front surface of said pliable body member, said restraining belt receiving member defining a restraining belt passageway, said pliable body member having detachable members attached to said front surface of said pliable body member for connecting to connecting members attached to said front surface of said pliable body member;

b) placing a child on said rear surface of said pliable body member whereby the child's legs substantially conform with said concave profiles;

c) forming the restraining device around the child by folding said rear surface of said cross-member over the child's front and between the child's legs whereby the child is sandwiched between said rear surface of said cross-member and said rear surface of said elongated member;

d) securing the child within a child receiving pocket defined between said rear surface of said cross-member and said rear surface of said elongated member by connecting said detachable members to said connecting members; and e) passing a restraining belt from a child seat device through said restraining belt passageway defined by said restraining belt receiving member whereby the restraining belt passing through said restraining belt receiving member limits movement of said child receiving pocket and the child received therein.

16. The method of restraining the child as claimed in claim 15 further comprising the step of attaching said restraining device with the child received in said child receiving pocket to the child seat device by an attachment belt, said attachment secured to said pliable body member whereby said attachment belt attached to the child seat device in combination with the restraining belt from the child seat device passing through said restraining belt receiving member further limits movement of said child receiving pocket and the child received therein.

17. A method of restraining a child comprising the steps of:

a) providing a restraining device having a pliable body with a child receiving pocket defined therein, said child receiving pocket having a mouth opening and leg openings, said pliable body having a restraining belt receiving member secured to an outer surface thereof, said restraining belt receiving member defining a restraining belt passageway;

b) receiving a child within said child receiving pocket by having its body pass through said mouth opening and legs pass through said leg openings;

c) passing a restraining belt from a supplemental child seat device through said restraining belt passageway defined by said restraining belt receiving member, wherein the restraining belt passing through said restraining belt receiving member limits movement of said pliable body and the child received therein; and d) attaching said restraining device with the child received in said child receiving pocket to the child seat device by an attachment belt, said attachment belt including two elongated flexible members secured to said pliable body and means for connecting said members to attach said attachment belt to the child seat device, wherein said attachment belt being attached to the child seat device in combination with the restraining belt from the child seat device passing through said restraining belt receiving member further limits movement of said pliable body and the child received therein.

* * * * *

UNITED STATES PATENT AND TRADEMARK OFFICE

CERTIFICATE OF CORRECTION

PATENT NO. : 5,957,537

DATED : September 28, 1999

INVENTOR(S) : Patricia K. Hoolahan

It is certified that error appears in the above-identified patent and that said Letters Patent is hereby corrected as shown below:

Column 4 Line 6 "crossmember" should read --cross-member--.

Column 7 Line 36, Claim 15, "crossmember" should read --cross-member--.

Column 8 Line 17, Claim 16, "attachment secured" should read --attachment belt secured--.

Signed and Sealed this

Twenty-fifth Day of April, 2000

*Attest:*

Q. TODD DICKINSON

*Attesting Officer*

*Director of Patents and Trademarks*